United States Patent [19]

Lee

[11] Patent Number: 4,979,632

[45] Date of Patent: Dec. 25, 1990

[54] PORTABLE VESSEL FOR THE SAFE STORAGE OF EXPLOSIVES

[75] Inventor: John T. M. Lee, Phoenixville, Pa.

[73] Assignee: ICI Americas Inc., Wilmington, Del.

[21] Appl. No.: 520,983

[22] Filed: May 9, 1990

Related U.S. Application Data

[63] Continuation of Ser. No. 318,040, Mar. 2, 1989.

[51] Int. Cl.[5] ..... B05D 45/02; F16J 13/02

[52] U.S. Cl. ..... 220/3; 220/325; 220/327

[58] Field of Search ..... 220/3, 323, 324, 325, 220/326, 327

[56] References Cited

U.S. PATENT DOCUMENTS

| | | | |
|---|---|---|---|
| 927,223 | 7/1909 | Chidester | 220/327 |
| 2,611,506 | 9/1952 | Scheer | 220/327 |
| 3,080,201 | 3/1963 | Escola | 220/327 |
| 3,141,008 | 7/1964 | Flick | 220/327 |
| 3,143,756 | 8/1964 | Sisko | 220/327 |
| 3,362,573 | 1/1968 | Wales | 220/326 |

FOREIGN PATENT DOCUMENTS

| | | | |
|---|---|---|---|
| 42098 | 5/1933 | France | 220/327 |

*Primary Examiner*—George E. Lowrance
*Attorney, Agent, or Firm*—Richard A. Rowe

[57] ABSTRACT

A portable quick opening storage vessel for safely storing explosive materials is presented. The relatively small cylindrical container is equipped with flat endplates and external retaining rods which absorb most of the explosive energy. Modifications include a quick open assembly for opening and closing the container.

6 Claims, 5 Drawing Sheets

PORTABLE VESSEL FOR THE SAFE STORAGE OF EXPLOSIVES

This is a continuation of copending application Ser. No. 318,040, filed on Mar. 2, 1989, now abandoned.

This invention is directed to the handling and storage of explosive materials. In particular, it is directed to a heavy walled vessel, in which specific quantities of explosive materials can be detonated or deflagrated without injury to those within its immediate surroundings. In particular, it is directed to a relatively small cylindrical vessel having thick end-plates which are contained by a multiplicity of external retaining rods radially equidisposed around the cylinder which serve as the primary containment structure. When mounted on a wheeled vehicle, the container may be used to safely transport and store explosives. Unique features include a mechanical quick opening arrangement such that the vessel can be opened and closed in a short time period, thus limiting the exposure to accidental detonations. The vessel may also be used as a dessicator and dryhouse storage container.

The U.S. Department of Defense, in March of 1986 published a "Contractor's Safety Manual for Ammunition and Explosives" which sets out regulations for private contractors to outline procedures which must be adhered to in the handling of explosives. This manual specifies in regulation DOD 4145.26-M that certain quantity/distance requirements must be adhered to if explosive materials are used. In general, the regulation requires, depending on the amount and type of explosive used or stored, that certain specified distances must be maintained between property lines, inhabited buildings, population densities, and the explosives. In many instances, existing facilities must be modified to meet these quantity/distance requirements in order that government contract regulations are met. It is anticipated that the storage and transport vessel of this invention can be used in place of making costly modifications to existing facilities now required by the federal regulation. The use of the storage vessel provides a means for containing an explosion or detonation such that no shrapnel or blast damage results when specified amounts of explosives contained therein are initiated.

The construction of the storage vessel is better understood by referring to the Figures which serve to illustrate but not limit the improvement offered by the invention:

Figure 4B:
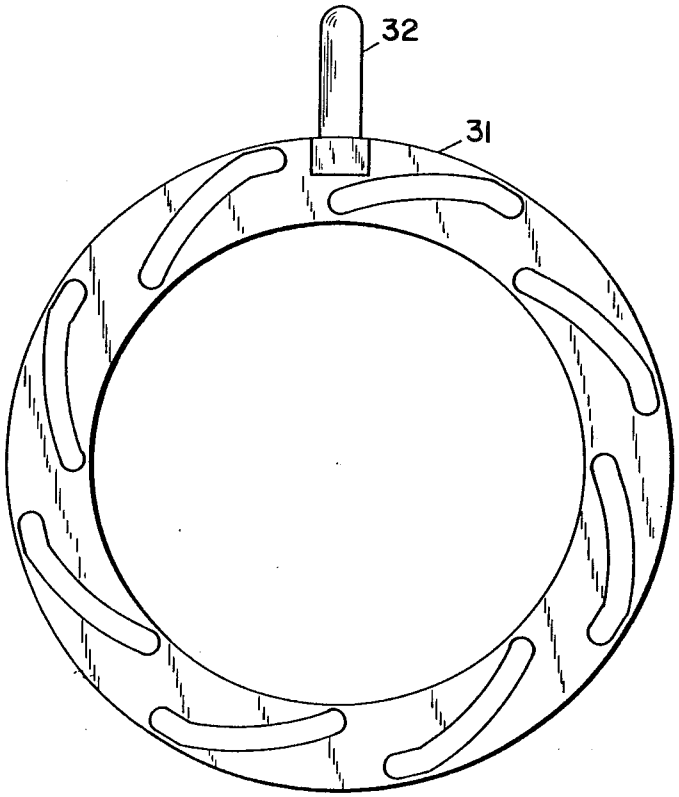
Figure 4A:
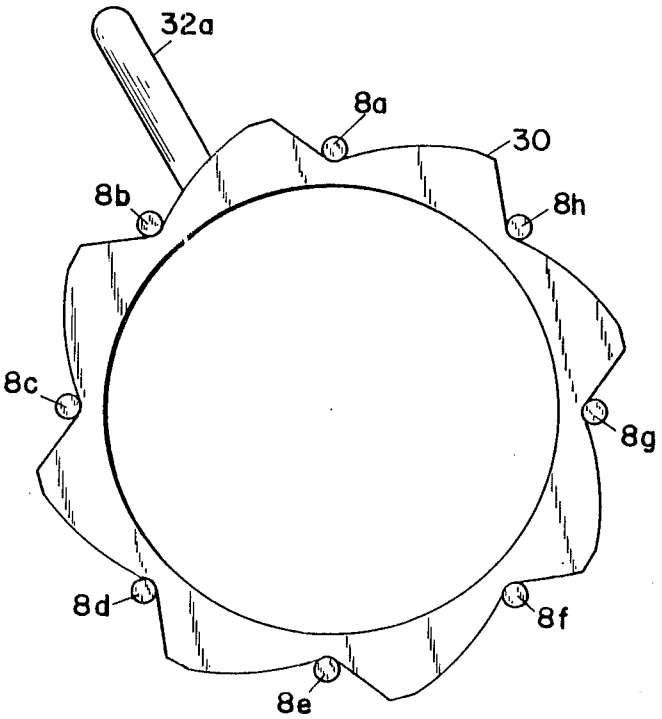

FIG. 4*a* shows the detail of an opening cam ring arrangement.

FIG. 4*b* shows the detail of a second cam ring arrangement.

Figure 4D:
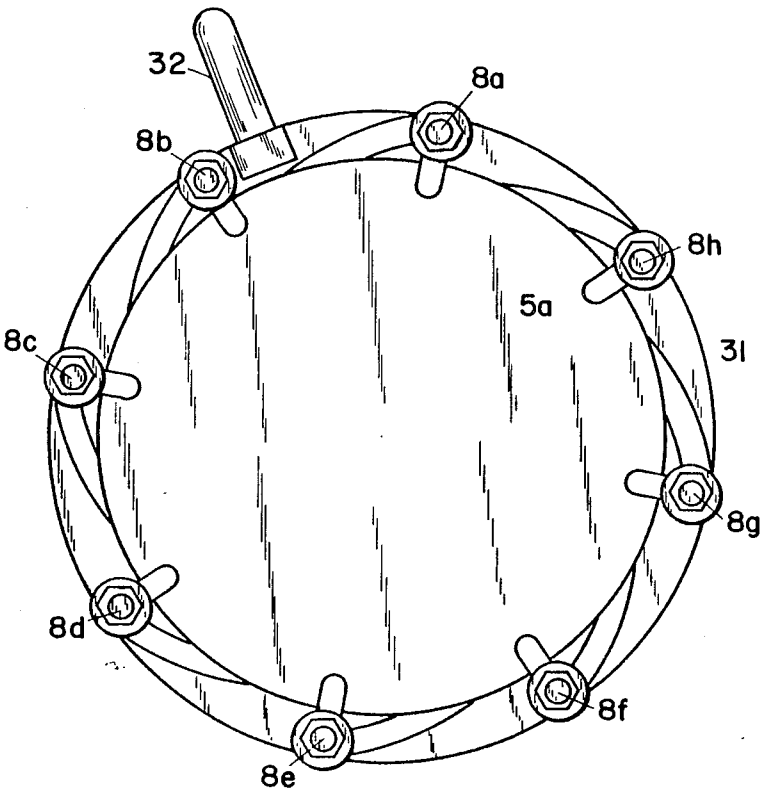
Figure 4C:
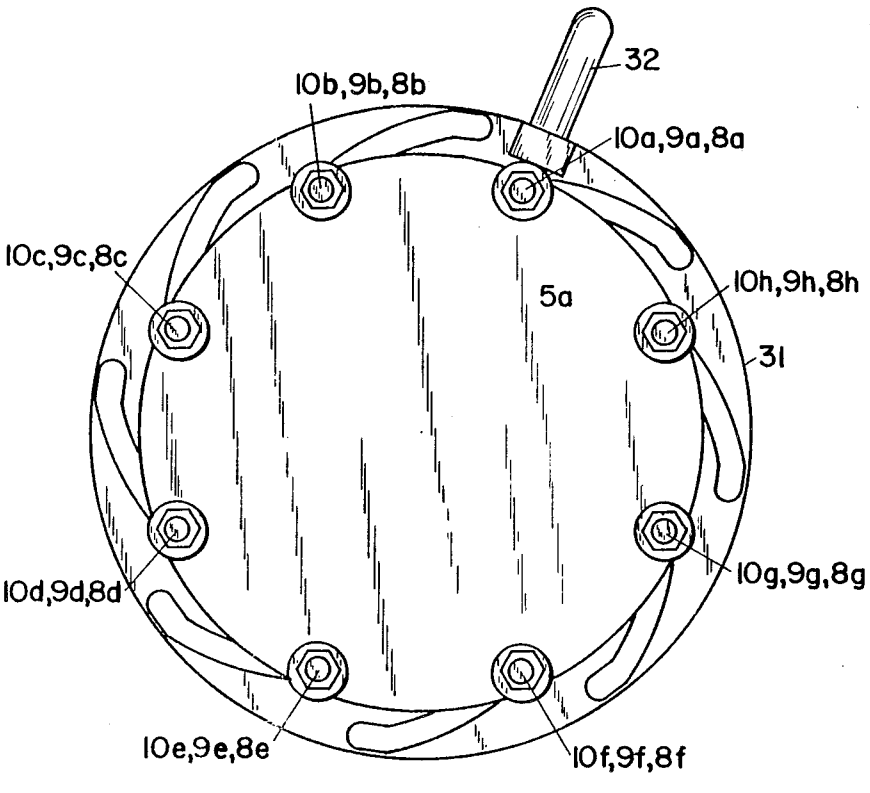

FIG. 4*c* shows the detail of the cam ring arrangement assembly in the closed position.

FIG. 4*d* shows a detail of the cam ring assembly in the open position.

Figure 5:
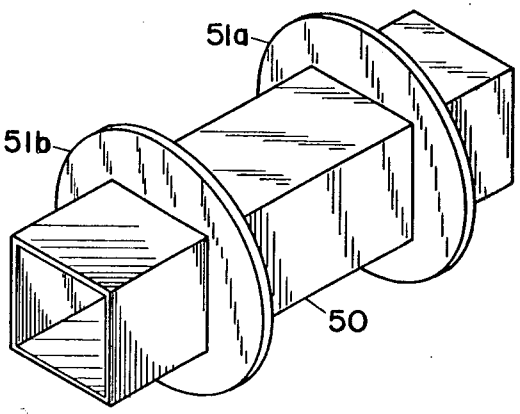

FIG. 5 shows the detail of an internal storage tray assembly.

Figure 6:
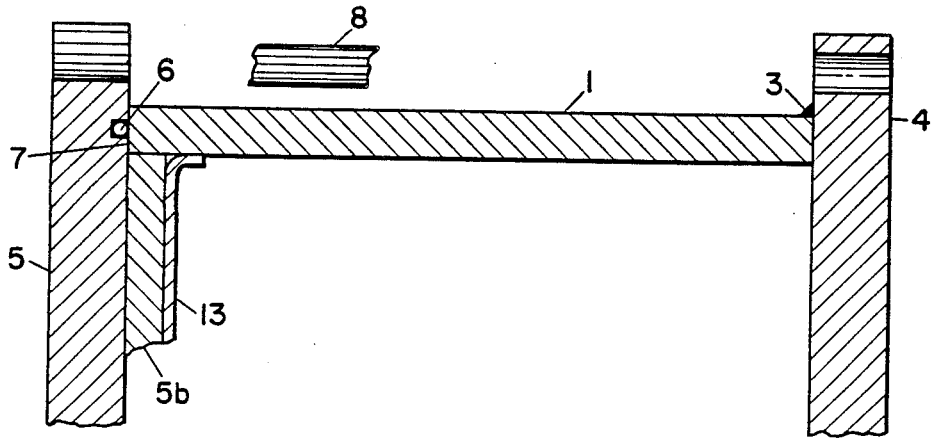

FIG. 6 is an alternate high pressure sealing technique.

Figure 7:
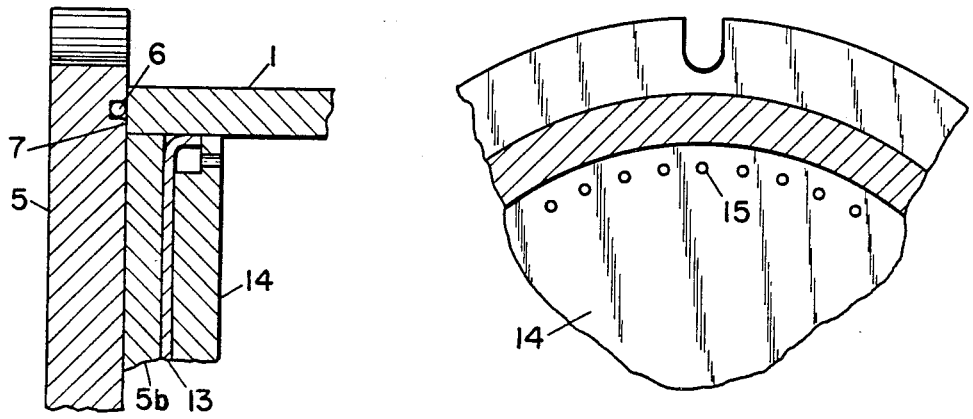

FIG. 7 is a second alternate high pressure sealing technique.

Figure 1:
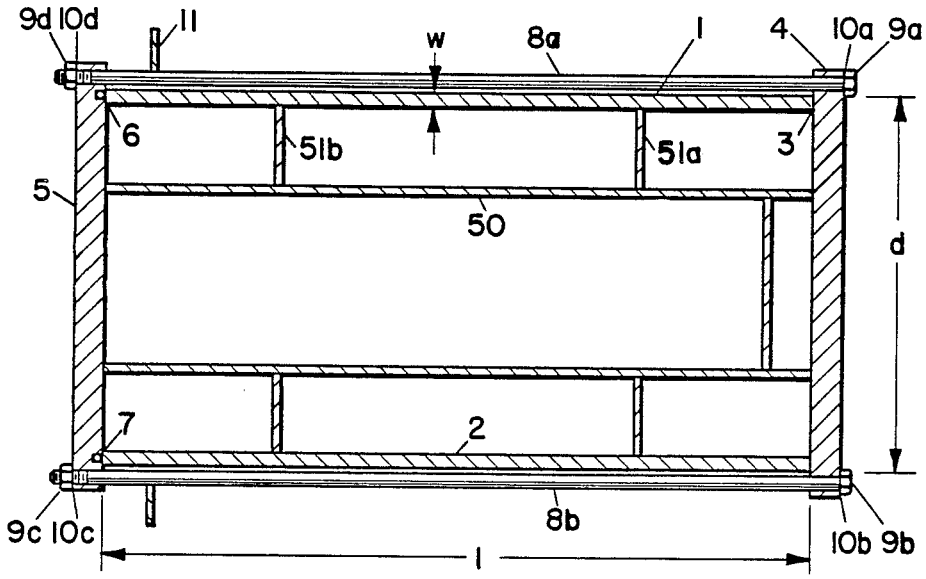
FIG. 1 is an elongated cross-sectional view cut through the axis, containing rods and internal support tray.

In FIG. 1 is shown major components of the storage vessel of the invention which comprises a metal cylinder (1) usually pipe having a diameter (d), length (1) and wall thickness (w) which are adjusted to contain a maximum amount of detonable explosives such as PETN, TNT, nitroglycerin, metal azide or deflagrating materials such as black powder. The wall thickness (w) is adjusted such that it does not burst when the maximum amount of detonable material is initiated at its internal surface (2) when closed. One end of the cylinder is sealed by weld using a full fillet weld seam (3) to the thick, flat flange metal end-plate (4). The opposite end of the cylinder is machined to receive a thick, flat flanged cover-plate (5) which is equipped with a gasket (6) sufficiently large to provide a vapor tight seal with the open cylinder end (7). The function of the gasket seal is to provide a moisture barrier for dry storage. The seal need not be sufficient to contain gases formed by detonation; however, a high pressure seal arrangement may be provided as shown in FIGS. 6 and 7 when needed. The cover-plate is held in compression with the end-plate by means of a multiplicity of steel elongated retaining rods (8*a*, 8*b* . . . ) which are positioned at radially equidisposed positions surrounding the perimeter of the cylinder which are fixed to the flanges of the end-plate and cover-plate by threaded nuts (9*a*, 9*b*, 9*c*, 9*d* . . . ). The number and thickness of retaining rods will increase directly proportional to the size of the detonable explosive to be within the vessel. Usually the rods are threaded such that they may be torqued by hand with nuts and washers (10*a*, 10*b*, 10*c*, 10*d* . . . ) sufficiently to provide a low pressure seal (7) at the cover-plate. The cumulative tensil strength at the retaining rods employed must be equivalent to the bursting strength of the cover-plate (5), end-plate (4) and cylinder (1).

Figure 2:
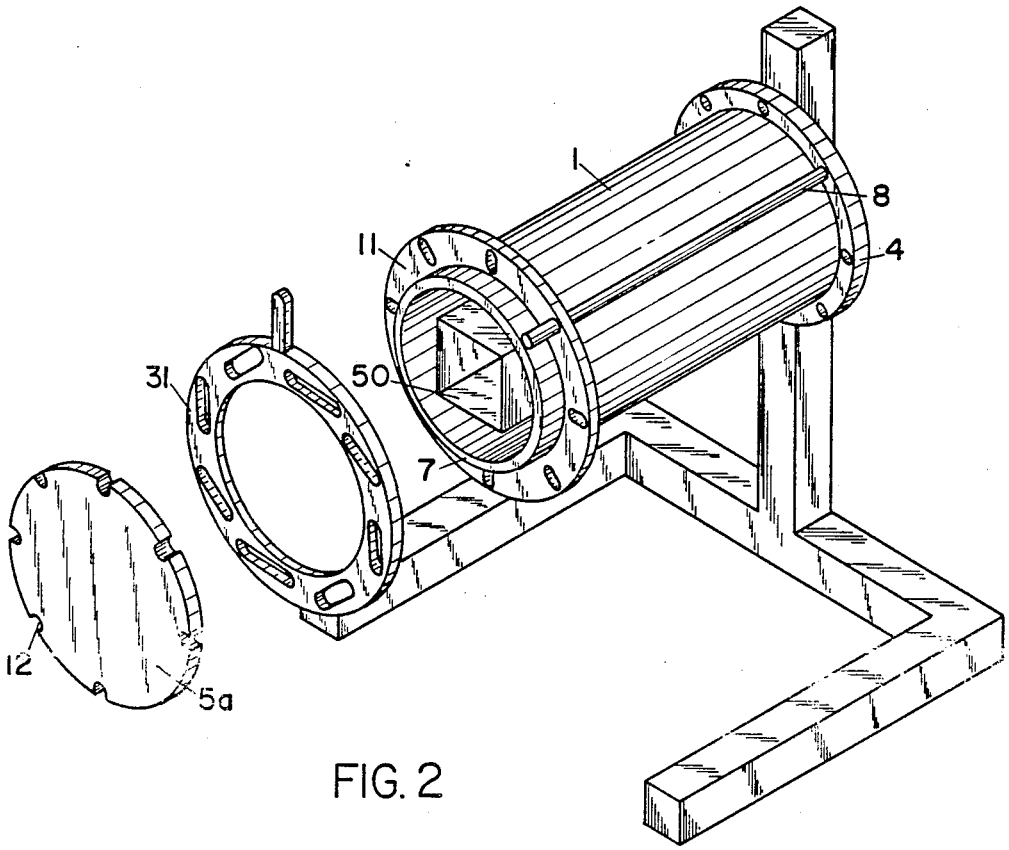
FIG. 2 is an exploded, rotated three-dimensional view showing a dolly support.
Figure 3:
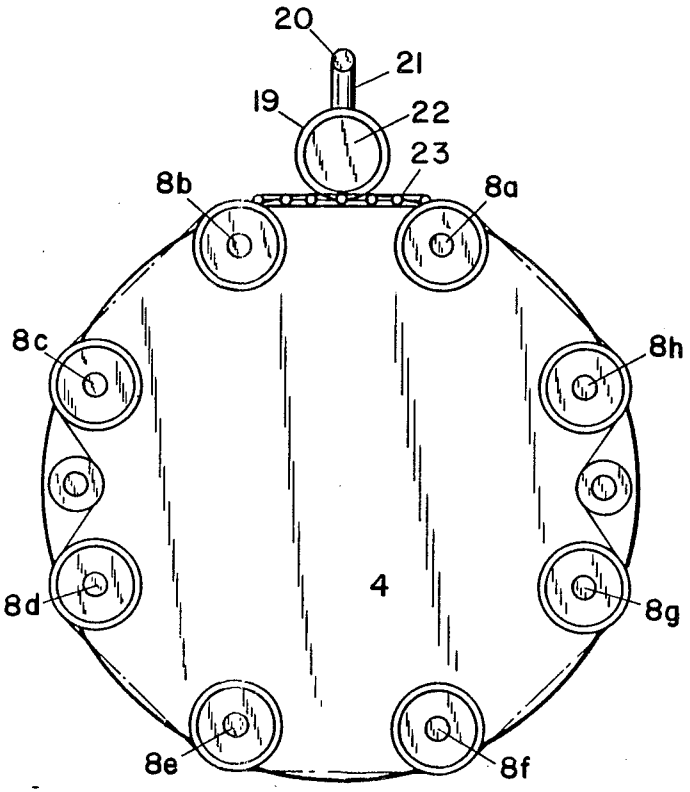
FIG. 3 is an end view showing an optional end plate and chain/sprocket detail.

With reference to FIGS. 2, 3 and 4, ancillary features of the storage container provide for means to open and remove the cover-plate. Such means may include wing nuts having a low number of threads to engage the cover plate in place of conventional nuts as shown at (9*c*) and (9*d*) having a low number threads to engage the cover-plate of the retaining rods passing through the bolt holes in the fixed retainer flange (11) positioned near the coverplate. When equipped with matching wing nuts, the cover-plate may be removed by hand loosening quickly the retaining nuts holding the plate. Usually hand tightened nuts are sufficient to provide a moisture barrier seal at the gasket.

With reference to FIGS. 3 and 4, another quicker opening arrangement is provided for by a hand crank assembly (20) which rotates simultaneously all the retaining rods (8*a*, 8*b*, 8*c*, 8*d*. . . ) or nuts to loosen or tighten the gasket seal (6) at the coverplate (5). One suitable arrangement incorporates a cog and wheel arrangement operating through hand cranked (20) through shaft (21) through cog wheel (22) which engages drive chain (23) which engages the individual nuts or rods as it turns to rotate and loosen the seal.

In another quick opening arrangement, the vessel is provided as indicated in FIG. 4*a* and 4*b*alternative rotating ring cam and slot ring cam arrangements (30) and (31) which are used in combination with a cover-plate (5*a*) having open sided bolt holes (12). With reference to FIGS. 4*c* and 4*d*, in operation, the cam (30) or (31) is rotated either left or right by forcing handle (32) or (32*a*) to the right or left to shift the retaining rods inwardly or outwardly depending on the position of the cam. When the rods are forced into the outward direction through the open side of the bolt holes (12) outside of the cover-plate (5*a*) so that the cover-plate may be lifted directly away from the opening.

Tests have indicated that least damage is done to the storage vessel when the explosive material is stored at a central location within the vessel. With reference to FIG. 5 is shown a sacrificial holding tray which can easily be removed and discarded or easily cleaned to remove any traces of explosives which may have spilled. A square central compartment is supported by spacing fins (51*a*) and (51*b*) which have circumferences slightly less than the interior diameter of the storage cylinder. The reusable trays are preferably manufactured from aluminum or other corrosion resistant metal: however, cardboard, wood and the like can be employed for those which are to be discarded.

When the vessel needs a high pressure seal, alternative arrangements such as shown in FIGS. 6 and 7 may be employed. At the interior surface of cover-plate (5) at location (7) may be welded an interior metal support plate (5*b*) having attached thereto a ductile metal cup seal (13). With reference to FIG. 7, this ductile metal seal may be further protected by a cover-plate or ring (14) having a multiplicity of perforations or holes (15) which act to permit gases generated upon detonation to pressurize the seal (13) against the interior wall of the cylinder (1).

The safe handling of explosives is demonstrated in the following examples:

EXAMPLE 1

A storage vessel similar to that shown in FIG. 1 having 60 cm length, 32 cm O.D., 11 mm wall thickness of mild steel with a 40 cm O.D., 2.6 cm thick welded mild steel end-plate, and a 44 cm O.D., 2.6 cm thick aluminum cover plate was tested with eight tempered carbon steel retaining rods having 16mm O.D. The cover-plate was sealed using a neoprene rubber O-ring with a cross-section of 5 mm and an O.D. of 31 cm. One stick of NE−1509 (86% PETN, 14% mineral oil) plastic explosive having a diameter of 18 mm and a length of 20.2 cms weighing 100 grams in connection with an Atlas Number 8 blasting cap was wired through a glass-to-metal sealed test hole passing through the end-plate and placed in the center of the vessel on a cardboard support similar to that shown in FIG. 5. The cover-plate was placed into position with nuts tightened by hand to provide a low pressure seal through the O-ring.

Upon detonation, a mild report was heard. However, all gases and flame was contained within with only the cardboard support being damaged. No change in external dimensions could be measured.

EXAMPLE 2

Employing the vessel of Example 1, three sticks of NE−1509 plasticized PETN measuring 18 mm O.D., 15 cms long weighing 200 grams were wired with an Atlas Number 8 blasting cap. Upon detonation, a loud report was heard and some flash was seen in the seal area. The total bulge measured from the central position of each end plate amounted to 1.092 cms with only slight bulging in the cylinder wall.

EXAMPLE 3

Employing the vessel of Example 2, three sticks of NE−1509 plasticized PETN measuring 18 mm O.D., 19 cms long weighing 250 grams were centered within the storage vessel on an aluminum tray similar to that shown in FIG. 5. The central square cross section of the tray measured 16 cms. Inside, the squared portion was placed from corner to corner a piece of cardboard to support the explosive sticks wired to a number 8 blasting cap.

Upon detonation, a loud report was heard with flash occurring at the O-ring seal. The total bulge occurring at the central portion of the end plates amounted to 3.5 cms with a bulge of 5.5 mm occurring at the cylinder wall.

EXAMPLE 4

One pound of black powder in an electrically conductive rubber tray was placed on the bottom of an untested storage vessel described in Example. 1.

When ignited by an Atlas match, almost no report was heard and no leakage occurred at the O-ring seal. The dimension of the vessel did not change.

EXAMPLE 5

Two pounds of Class 7 black powder were placed on the bottom of the storage vessel of Example 4 in two rubber trays, each containing one pound.

When ignited with an Atlas match, a loud hiss with flame was emitted at the O-ring gasket; however, no dimensional changes in the vessel could be measured.

EXAMPLE 6

Eight conductive rubber flats, each containing 60 grams of dextrinated lead azide (three 20 gram cups per flat) were placed centrally in the vessel of Example 3, supported by a cardboard cross member. The total charge weight was 480 grams. No O-ring was used on the cover-plate. An alternate high pressure seal was used as shown in FIG. 6.

When detonated by a member 8 blasting cap, a very mild report was heard and no flame could be seen. The gas produced by the detonation could be heard venting past the seal for approximately 10 seconds. The central girth of the vessel was measured before and after the test and there was no dimensional increase.

What is claimed is:

1. A quick opening vessel for the safe storage of explosives comprising an elongated thick walled metal cylinder having a flat, thick metal, flanged end-plate completely closing one end by a weld, and open end, a flat, thick metal cover plate with gasket means to engage said open end, and improved means for compressing said cover plate against said open end to engage said gasket means, said improved means comprising a multiplicity of steel elongated retaining rods passing outside of and parallel to said cylinder through the closed end flange at one end and the cover plate at the other end, said rods having threaded ends and matching threaded nuts wherein the number of threads on said elongated rods and nuts are low enough to provide quick opening, but high enough to retain the detonation force of said stored explosive, and mechanical means for turning said bolts or rods simutaneously quickly open or tighten said cover plate against said gasket means comprising a hand cranking means engaging a continuous band of flexible material in mechanical contact contact with said nuts whereby when said crank is turned said nuts or rods are rotated. p1 said quick opening further provided by a rotating ring cam in combination with said cover plate having open sided bolt holes wherein when said cam is rotated, said rods are moved outwardly outside the diameter of said cover plates, said rods equally disposed radially around the perimeter of said cylinder such that when said nuts are tightened, a low pressure seal is formed at said gasket means, said rods having cumulative tensile strength at least equal to the bursting strength of said cover plate, end plate and cylinder, said rods carrying essentially the entire axial force tending to separate the end plates which results from an internal explosion thereby minimizing the stress is said weld.

2. A vessel of claim 1 wherein the bursting strength of said cylinder is high enough to retain the detonable or deflagratable explosive materials stored therein.

3. A vessel of claim 1 wherein said means for simultaneously moving said rods comprises a sliding flat circumferential cam ring mounted on said cylinder having an internal diameter slightly larger than said cylinder and a varying external surface perimeter which engages said rods such that when said ring is moved about said cylinder, said rods are forced outwardly.

4. A vessel of claim 1 wherein said continuous band is a chain engaging a sprocket wheel fixed to said rods or nuts.

5. A vessel of claim 1 further comprising a removable internal tray having sides, bottom and support positioning means to position said bottom portion at the axis of said cylinder.

6. A vessel of claim 1 mounted on a dolly support.

* * * * *